United States Patent [19]

Iten

[11] 4,322,002

[45] Mar. 30, 1982

[54] PACKAGE FOR SECURING SLOTTED SAFETY RAZORS

[75] Inventor: Clemens A. Iten, Staunton, Va.

[73] Assignee: American Safety Razor Company, Verona, Va.

[21] Appl. No.: 159,728

[22] Filed: Jun. 16, 1980

[51] Int. Cl.[3] ..... B65D 73/00; A45D 27/29

[52] U.S. Cl. ..... 206/493; 206/349; 206/459

[58] Field of Search ..... 206/349, 352, 353, 493, 206/491, 472, 474, 477, 482, 228, 481, 485, 499, 459

[56] References Cited

U.S. PATENT DOCUMENTS

| | | | |
|---|---|---|---|
| 1,588,432 | 6/1926 | Webb | 206/336 |
| 1,831,145 | 11/1931 | Sherman | 206/228 |
| 2,125,246 | 7/1938 | Meyer | 206/491 |
| 2,286,704 | 6/1942 | Apt | 206/337 |
| 2,706,041 | 4/1955 | Tate | 206/336 |
| 2,840,235 | 6/1958 | Volokening et al. | 206/493 |
| 2,890,801 | 6/1959 | Ladd et al. | 206/493 |
| 3,354,545 | 11/1967 | Shrader | 30/85 |
| 3,413,720 | 12/1968 | Mullen | 30/85 |
| 3,550,768 | 12/1970 | Briggs | 126/63 |
| 4,018,341 | 4/1977 | Jarecki | 211/59.1 |
| 4,266,664 | 5/1981 | Dixon et al. | 206/485 |

*Primary Examiner*—William T. Dixson, Jr.

*Attorney, Agent, or Firm*—Wender, Murase & White

[57] ABSTRACT

A generally matchbook-shaped package includes a narrowed panel for passing through mating slots in the handles of stacked safety razors. A safety cap is positioned on the bladed portion of the razors and may be easily discarded when ready for use.

5 Claims, 7 Drawing Figures

PACKAGE FOR SECURING SLOTTED SAFETY RAZORS

FIELD OF THE INVENTION

The present invention relates to packages, and more particularly to a package for securing a number of disposable safety razors therein.

BRIEF DESCRIPTION OF THE PRIOR ART

A number of packages exist for disposable safety razors which are generally sold in packages containing more than one razor. An example of prior art packaging is demonstrated in FIG. 1 herein and is the subject matter of U.S. patent application Ser. No. 133,779, which was filed on Mar. 26, 1980, and is assigned to the assignee of the present invention. This prior art is an improvement of a currently distributed package which contains the GOOD NEWS disposable razors manufactured and distributed by The Gillette Company.

Although the prior art packaging of FIG. 1 is generally satisfactory for accomplishing its intended purpose, there is an unnecessary use of packaging material. Further, the referred-to prior art packaging does not enable a consumer to closely inspect the entire product prior to purchase.

BRIEF DESCRIPTION OF THE PRESENT INVENTION

The present invention includes a package which may generally be characterized as resembling a matchbook including confronting panels. The invention further includes mating razors, each of which is provided with an elongated slot in its handle. One of the package panels is adapted to pass through the slots of a number of stacked razors and the ends of the package are fastened together so that the razors are secured within the package The structure of the present invention decreases the amount of package material required, as compared with the prior art. By mounting safety razors in the present package, the entire length of the article is available for inspection by a consumer prior to purchase.

In the preferred embodiment of the invention, the package material may be cardboard so that it is easily torn to permit removal of a razor by a consumer, as it is needed.

The above-mentioned objects and advantages of the present invention will be more clearly understood when considered in conjunction with the accompanying drawings, in which:

DETAILED DESCRIPTION OF THE INVENTION

Figure 1:
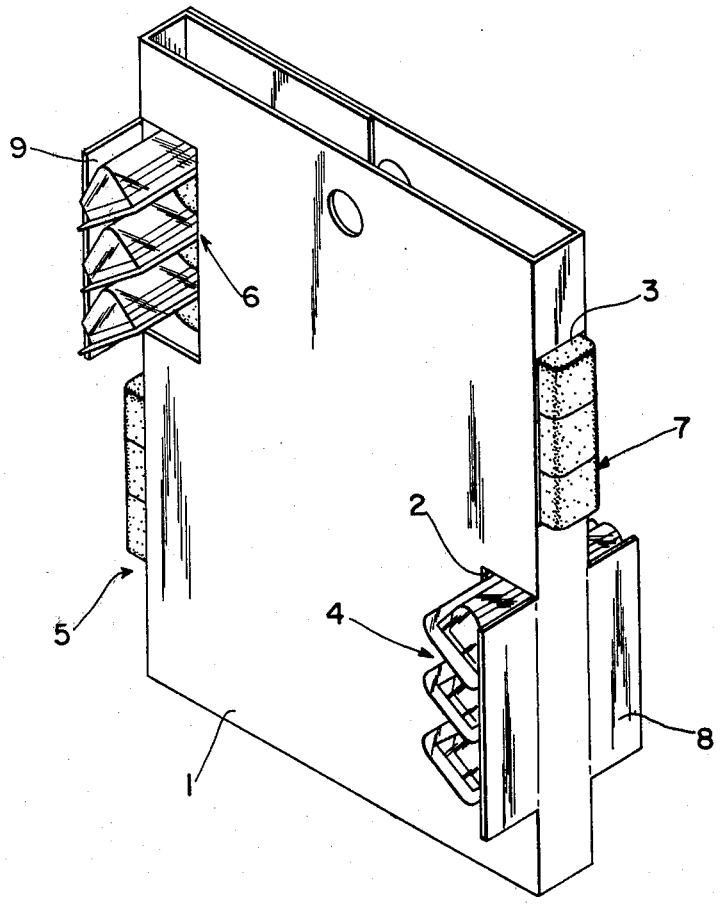
PRIOR ART FIG. 1
FIG. 1 is a perspective view of the prior art disposable razor package.

Before disclosing the structure of the present invention, it is well to consider FIG. 1 which illustrates the prior art package disclosed in the referenced copending application. A rectangular, hollowed cardboard package 1 has at least one cutout 2 for receiving the head portions of a first group of disposable razors 4. A rectangular cutout such as 3 on a side panel of the package permits the passage of handle ends therethrough, such as shown by reference numerals 5 in FIG. 1. The heads of a second group of razors, generally indicated by reference numeral 6, may be positioned in opposing relationship with the first mentioned set of razors. The handle ends, generally indicated by reference numeral 7, correspond to the second mentioned group of razors. Flaps 8 and 9 are cut from the front and back panels of the package and serve to restrain the razors within the package. In order to retrieve a razor, the package is simply torn and a razor removed.

Figure 2:
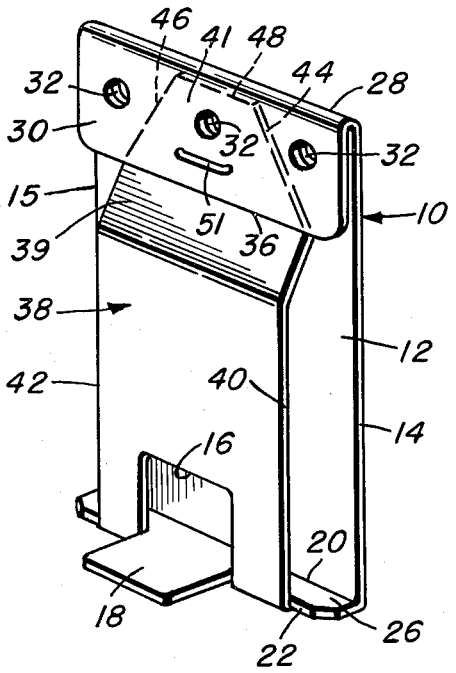
FIG. 2 is a perspective view of the present package design.
Figure 3:
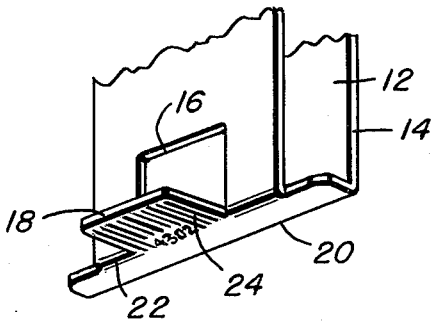
FIG. 3 is a partial perspective view illustrating a bottom portion of the present package design.
Figure 5:
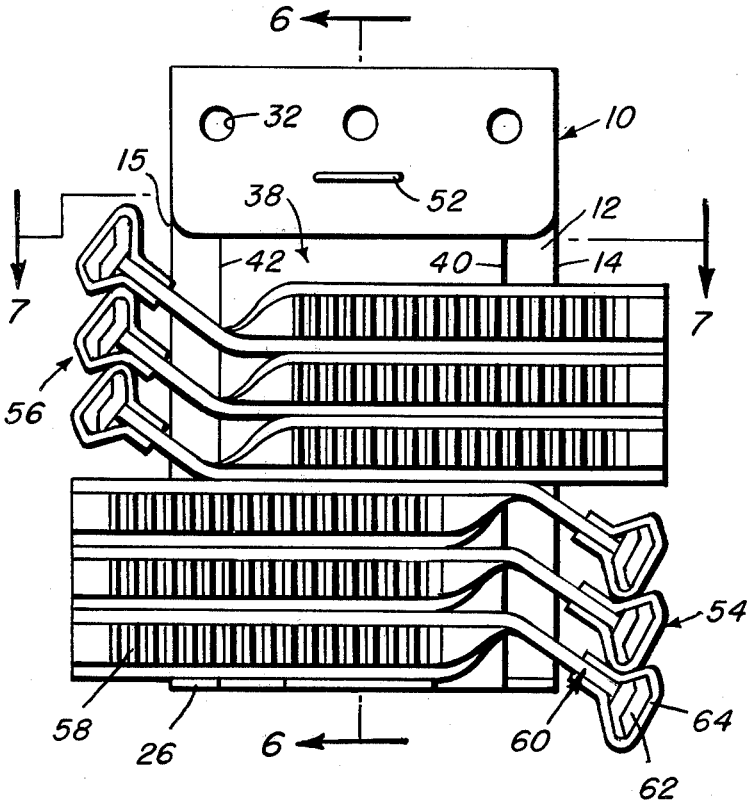
FIG. 5 is a rear view of the present inventive package illustrating the mounting of inventive disposable razors having elongated slots therein which are engaged by a panel of the package.
Figure 6:
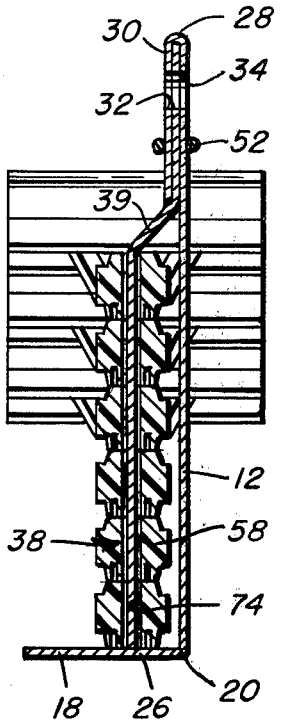
FIG. 6 is a vertical cross sectional view taken along section line 6—6 in FIG. 5.

FIG. 2 illustrated an improvement over the prior art by including an inventive package, somewhat resembling a matchbook which may be fabricated from cardboard, plastic or the like. The package is generally indicated by reference numeral 10 and is seen to include a first vertical panel 12 having parallel vertical edges 14 and 15. A generally rectangular cutout 16 is formed in a second vertical panel 38 positioned in overlying relation with the first panel 12. A flap 18, resulting from the cutout 16, extends outwardly from the package and provides a surface 24 on which a price marking or machine readable price code may be imprinted. A bottom panel 26 articulates between the panels 12 and 38, the bottom panel having a common edge 20 with panel 12. The bottom panel 26 has a parallel situated edge 22 from which the flap 18 extends. The bottom panel 26 provides support for the lowermost razor, inserted in the package, as shown in FIGS. 5 and 6. A fold 28 separates the panel 12 from a fold-over flap 30, the latter terminating in an outer edge 36. Mounting holes 32 are punched in the flap 30 while a second set of mounting holes 34 (FIG. 4) are punched in panel 12. When the flap 30 is positioned in overlying relationship with panel 38, each of the holes 32 is positioned in registry with a corresponding hole 34, thereby permitting the package to be hung on a display rack. When a number of razors are positioned in the package, as shown in FIG. 5, the panel 38 (FIG. 2) will bend inwardly along panel portion 39 until the upwardly illustrated tapered end section 41 of panel 38 may be disposed in intermediate juxtaposition between a confronting section of panel 12 and a confronting surface of flap 30.

Figure 4:
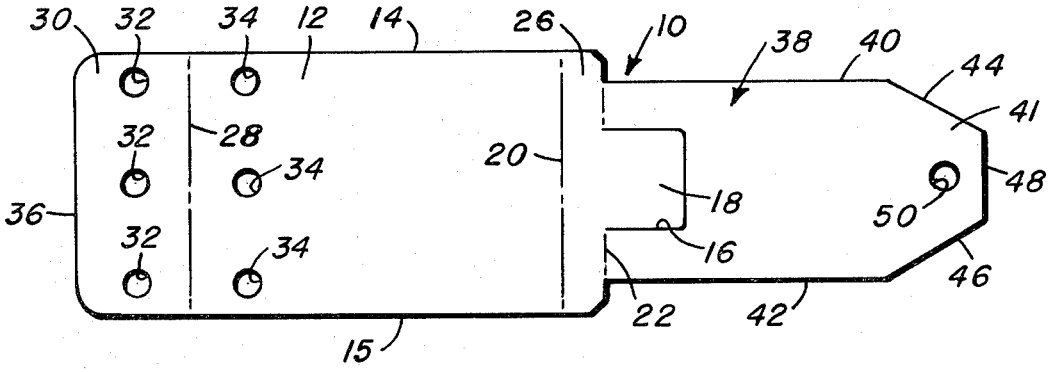
FIG. 4 is a plan view of a package blank which constitutes the present invention.

As clearly illustrated in FIG. 4, the end section 41 includes inwardly inclined edges 44 and 46, respectively extending from vertical edges 40 and 42 of panel 38. The outward end of panel 38 terminates in edge 48 and mounting hole 50 is punched in panel 38 so that it may be positioned in registry with the centrally positioned mounting holes 32 and 34, when the package is set up. A staple 52 (FIG. 2) is shown as securing together flap 30, panel 12 and end section 41. However, it should be appreciated that other fasteners or paste may be employed. The mounting holes permit storage of the package 10 on a display rack.

A number of razors, preferably disposable razors, are shown in FIG. 5 as stacked in a package 10. For purposes of illustration, the package illustrated is shown to house six razors. However, this number is by no means to be considered a limitation of the inventive package.

The inventive disposable razors illustrated are particularly suited for mounting in a package 10. A first group of three razors, generally indicated by reference numeral 54 is positioned in underlying relation to a second set of razors 56. Viewing the bottommost illustrated razor, a handle 58 extends to a neck portion 60 from which a razor head 62 depends. In the preferred embodiment of the invention, the head 62 may be in the form of a twin bladed cartridge which is pivotally mounted to the neck portion 60. Although six razors are shown packaged, this number is not a limitation of the invention.

Figure 7:
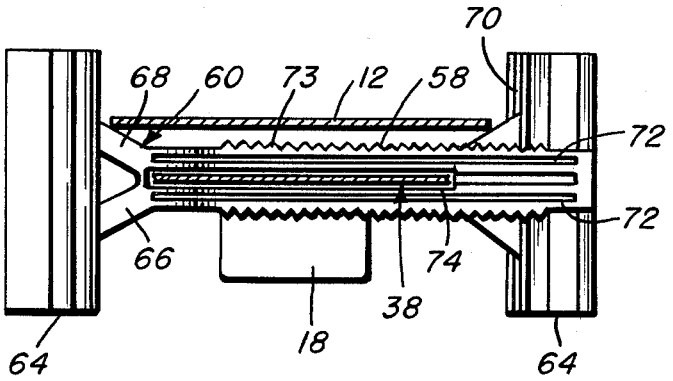
FIG. 7 is a horizontal sectional view taken along section line 7—7 in FIG. 5.

FIG. 7 illustrates the neck portion 60 to include bifurcations 66 and 68 mounted to head 62. In FIG. 7, the right illustrated razor cap 64 is seen to include an elongated slit 70 which permits the sliding insertion and removal of cap 64 on the razor head 62. The cap may be fabricated from a plastic material.

Elongated grooves 72 may be axially formed along the length of each razor handle while knurls 73 may characterize the remaining surface of the razor to assist the user in firmly gripping it.

Of extreme significance is the formation of an elongated, axially disposed slot 74 through the body of each razor handle to permit the passage of package panel 38 therethrough. The end section 41 (FIG. 4) permits rapid mounting of razors along panel 38 prior to assembly of package 10. The positioning of the first razor group 54 is opposite relationship to the razor group 56 allows for the compact packaging of razors but is not necessary.

As will be appreciated from viewing FIG. 5, the entire length of the razors are subject to inspection by a consumer when the package 10 is positioned as shown in FIG. 5. When the package is turned over, the outward surface of panel 12 is available for the printing of graphic information.

It should be understood that the invention is not limited to the exact details of construction shown and described herein for obvious modifications will occur to persons skilled in the art.

I claim:

1. A package for safety razors comprising:

at least one safety razor having a handle defining an elongated opening therein for receiving a package panel passing through the opening, a bridge portion extending outwardly from the handle, and a blade containing head pivotally mounted to the bridge portion;

first and second generally planar, opposing panels spaced from one another in a generally parallel relationship;

a third panel articulating between the first and second panels and adapted to prevent displacement of the razors from a corresponding first end of the package;

means for securing the first and second panels together at a second end of the package; and the first panel adapted to pass through aligned ones of said elongated openings formed in the handles of a plurality of stack mounted razors thereby securing them to the package such that said razors are maintained by said package in a stacked presentation.

2. The package set forth in claim 1 together with a flap formed from a cutout in one of the panels, the flap providing a surface for machine-readable code thereon.

3. The subject matter set forth in claim 1 together with openings formed in the package to permit mounting of the package on a display rack.

4. A blank for a safety razor package, comprising: a generally flat, elongated member having a generally rectangular central panel, a first generally rectangular end panel joined to said central panel at a first end along a first fold line, and a second generally rectangular end panel joined to said central panel along a second end by a second fold line; said second end panel having a first portion connected to said central panel and a second portion connected to said first portion by a third fold line; said third fold line being interrupted by a generally rectangular flap cut from said second portion and extending from and contiguous with said first portion, said second portion of said second end panel being adapted to pass through aligned elongated openings formed in the handles of a plurality of stack mounted razors to thereby secure the same to the package.

5. A package blank as recited in claim 4, wherein said second portion of said second end panel has a width less than the width of said first portion.

* * * * *